US008137212B2

(12) United States Patent
Hebert et al.

(10) Patent No.: US 8,137,212 B2
(45) Date of Patent: Mar. 20, 2012

(54) TREATMENT FOR FACILITATING BONDING BETWEEN GOLF BALL LAYERS AND RESULTANT GOLF BALLS

(75) Inventors: Edmund A. Hebert, Fairhaven, MA (US); Mitchell E. Lutz, Fairhaven, MA (US); Thomas Mydlack, Rochester, MA (US)

(73) Assignee: Acushnet Company, Fairhaven, MA (US)

( * ) Notice: Subject to any disclaimer, the term of this patent is extended or adjusted under 35 U.S.C. 154(b) by 1047 days.

(21) Appl. No.: 10/452,722

(22) Filed: Jun. 3, 2003

(65) Prior Publication Data

US 2003/0199337 A1 Oct. 23, 2003

Related U.S. Application Data

(63) Continuation of application No. 09/912,517, filed on Jul. 26, 2001, now Pat. No. 6,609,982, which is a continuation of application No. 09/389,058, filed on Sep. 2, 1999, now Pat. No. 6,315,915.

(51) Int. Cl.
*A63B 37/12* (2006.01)

(52) U.S. Cl. ..... 473/373

(58) Field of Classification Search ..... 473/351–378
See application file for complete search history.

(56) References Cited

U.S. PATENT DOCUMENTS

| | | | | |
|---|---|---|---|---|
| 3,262,272 | A | 7/1966 | Barakauskas et al. | 60/39.05 |
| 3,333,032 | A | 7/1967 | Dickinson | 264/22 |
| 3,355,313 | A | 11/1967 | Eastes | 117/47 |
| 3,539,443 | A | 11/1970 | Jackson, Jr. | 161/186 |
| 3,661,671 | A | 5/1972 | Katagiri et al. | 156/78 |
| 3,678,933 | A | 7/1972 | Moore et al. | 128/296 |
| 3,959,567 | A | 5/1976 | Bradley | 428/461 |
| 4,008,352 | A | 2/1977 | Dawes et al. | 428/474 |
| 4,049,904 | A | 9/1977 | Hori et al. | 174/107 |
| 4,060,664 | A | 11/1977 | McGuire et al. | 428/336 |
| 4,091,166 | A | 5/1978 | Kubacki | 428/411 |
| 4,092,452 | A | 5/1978 | Hori et al. | 428/215 |
| 4,120,716 | A | 10/1978 | Bonet | 156/272 |

(Continued)

FOREIGN PATENT DOCUMENTS

JP 59-144465 A 8/1984

(Continued)

OTHER PUBLICATIONS

Kaplan, S. L., *Cold Gas Plasma Treatment for Re-engineering Films*, Paper Film Foil Converter, vol. 71(6): 5 pages (Jun. 1997).

(Continued)

*Primary Examiner* — Alvin Hunter
(74) *Attorney, Agent, or Firm* — Murphy & King, P.C.

(57) ABSTRACT

The present invention is directed towards a multilayer golf ball which comprises a core having a treated surface and a cover layer having a plurality of dimples, wherein the cover layer is disposed concentrically about the core and bonded to the core preferably without an adhesive. The multilayer golf balls may alternatively or additionally be formed such that at least one layer of the core has a treated surface and is bonded, preferably without an adhesive, to an adjacent layer. The golf balls may be prepared by forming a first portion of a golf ball, wherein the first portion has a surface, treating the surface of the first portion to increase the adhesion thereof, and bonding at least a portion of a second portion concentrically about the surface of the portion.

22 Claims, 1 Drawing Sheet

U.S. PATENT DOCUMENTS

| | | | | |
|---|---|---|---|---|
| 4,139,660 | A | 2/1979 | Tur | 27/353 |
| 4,141,771 | A | 2/1979 | Barker et al. | 156/222 |
| 4,180,427 | A | 12/1979 | Bertsch | 156/272 |
| 4,264,075 | A | 4/1981 | Miller | 473/372 |
| 4,361,596 | A | 11/1982 | Dukhovskoi et al. | 427/41 |
| 4,613,403 | A | 9/1986 | Oyachi et al. | 156/643 |
| 4,649,097 | A | 3/1987 | Tsukada et al. | 430/270 |
| 4,871,589 | A | 10/1989 | Kitaoh et al. | 427/322 |
| 4,919,434 | A | 4/1990 | Saito | |
| 4,940,521 | A | 7/1990 | Dinter et al. | 204/164 |
| 5,006,297 | A | 4/1991 | Brown et al. | 264/234 |
| 5,041,304 | A | 8/1991 | Kusano et al. | 427/41 |
| 5,087,514 | A | 2/1992 | Graefe | 428/315.5 |
| 5,098,483 | A | 3/1992 | Little et al. | 148/4 |
| 5,143,748 | A | 9/1992 | Ishikawa et al. | 427/40 |
| 5,194,291 | A | 3/1993 | D'Aoust et al. | 148/276 |
| 5,198,724 | A | 3/1993 | Koinuma et al. | 316/111.21 |
| 5,221,427 | A | 6/1993 | Koinuma et al. | 156/643 |
| 5,286,532 | A | 2/1994 | Yoshikawa et al. | 427/536 |
| 5,316,739 | A | 5/1994 | Yoshikawa et al. | 422/186.05 |
| 5,334,673 | A | 8/1994 | Wu | |
| 5,369,336 | A | 11/1994 | Koinuma et al. | 315/111.21 |
| 5,387,842 | A | 2/1995 | Roth et al. | 315/111.21 |
| 5,403,453 | A | 4/1995 | Roth et al. | 204/164 |
| 5,414,324 | A | 5/1995 | Roth et al. | 315/111.21 |
| 5,419,861 | A | 5/1995 | Verzaro | 264/82 |
| 5,456,954 | A | 10/1995 | Sullivan | 427/553 |
| 5,456,972 | A | 10/1995 | Roth et al. | 428/224 |
| 5,466,424 | A | 11/1995 | Kusano et al. | 422/186.05 |
| 5,484,870 | A | 1/1996 | Wu | 528/28 |
| 5,651,741 | A | 7/1997 | Masutani et al. | 473/200 |
| 5,692,974 | A | 12/1997 | Wu et al. | 473/377 |
| 5,703,194 | A | 12/1997 | Malik | 528/70 |
| 5,733,428 | A | 3/1998 | Calabria et al. | 264/134 |
| 5,752,888 | A * | 5/1998 | Maruko et al. | 473/361 |
| 5,759,676 | A | 6/1998 | Cavallaro | 428/215 |
| 5,779,562 | A | 7/1998 | Melvin | 473/373 |
| 5,783,348 | A | 7/1998 | Tyagi | 430/124 |
| 5,820,489 | A | 10/1998 | Sullivan et al. | 473/377 |
| 5,833,553 | A | 11/1998 | Sullivan et al. | 473/374 |
| 5,885,172 | A | 3/1999 | Hebert | 473/354 |
| 5,888,437 | A | 3/1999 | Calabria et al. | 264/135 |
| 5,908,358 | A | 6/1999 | Wu | 473/378 |
| 5,976,035 | A | 11/1999 | Umezawa | 473/364 |
| 5,985,370 | A | 11/1999 | Ohira et al. | 427/322 |
| 6,013,153 | A | 1/2000 | Koinuma et al. | 156/272.6 |
| 6,013,331 | A | 1/2000 | Ogawa et al. | 427/515 |
| 6,103,166 | A * | 8/2000 | Boehm et al. | 264/250 |
| 6,106,415 | A | 8/2000 | Masutani | 473/374 |
| 6,231,460 | B1 | 5/2001 | Higuchi et al. | 473/351 |
| 6,315,915 | B1 | 11/2001 | Hebert et al. | 156/272.6 |
| 6,334,819 | B2 * | 1/2002 | Ichikawa et al. | 473/371 |
| 6,609,982 | B2 * | 8/2003 | Hebert et al. | 473/371 |

FOREIGN PATENT DOCUMENTS

| | | | |
|---|---|---|---|
| JP | 60-215374 | A | 10/1985 |
| JP | 2-131786 | A | 5/1990 |
| JP | 2-131787 | A | 5/1990 |
| JP | 7-132554 | A | 5/1995 |
| JP | 10-179795 | | 7/1998 |
| JP | 10-248959 | | 9/1998 |

OTHER PUBLICATIONS

Stobbe, B. D., *Corona Treatment 101 Understanding the Basics from a Narrow Web Perspective*, Label & Narrow Web Industry, 3 pages (Jun. 1996).

Rose, P. W. et al., *Treating Plastic Surfaces with Cold Gas Plasmas*, Plastics Engineering, pp. 41-45 (Oct. 1985).

* cited by examiner

TREATMENT FOR FACILITATING BONDING BETWEEN GOLF BALL LAYERS AND RESULTANT GOLF BALLS

This application is a continuation of U.S. patent application Ser. No. 09/912,517, filed Jul. 26, 2001 now U.S. Pat. No. 6,609,982, which is a continuation of U.S. patent application Ser. No. 09/389,058, filed Sep. 2, 1999, now U.S. Pat. No. 6,315,915, the disclosures of which are incorporated in their entirety by reference herein.

FIELD OF THE INVENTION

This invention relates to methods for treating one or more layers in a multilayer golf ball to facilitate bonding therebetween, and the resultant golf balls prepared with the treatment of a layer therein.

BACKGROUND OF THE INVENTION

Golf balls are typically divided into two general types or groups: a) solid golf balls and b) wound balls. The difference in play characteristics resulting from these different types of constructions can be quite significant. Solid golf balls may be one-piece or multilayer, while wound balls always have at least three layers of at least a center, wound layer, and a cover.

Solid golf balls having a two-piece construction are generally most popular with the recreational golfer because they provide a durable ball capable of achieving long distances in play. Two-piece balls are typically made with a single solid core, usually formed of a crosslinked rubber, which is encased by a cover material. Typically the solid core is made of polybutadiene chemically crosslinked with a metal salt of an unsaturated fatty acid and/or similar crosslinking agents. Covers typically are ionomers and blends of ionomers with other thermoplastics, such as SURLYN® resins, which are ionomer resins sold commercially by E. I. DuPont de Nemours of Wilmington, Del., or IOTEK®, which is sold commercially by Exxon Corporation.

Solid golf balls having three or more layers are more expensive to produce, but often provide improved playing characteristics. Such balls typically have a rubber-based spherical center around which is concentrically disposed one or more intermediate layers, also known as mantle layers. One or more cover layers are typically disposed concentrically about the intermediate layer(s) similar to two-piece golf balls.

Wound balls typically have either a solid or liquid filled center around which a tensioned elastomeric material (i.e., a stretched elastic thread) is wound to form a core. The wound core is then covered with a cover material, which may be the same as those discussed above for solid golf balls but also typically include balata (trans-polyisoprene) and urethanes. However, like three-piece multilayer solid golf balls, the more complex structure of wound balls generally results in a longer manufacturing time and greater expense in the production thereof compared to a two-piece ball.

One difficulty common to preparing solid multilayer balls is that materials of an outer layer do not necessarily bond well with the materials used in the inner layer(s). This can result in layer separation, particularly when the golf ball is struck by a club, which can detrimentally affect the playability and appearance of the golf ball. Moreover, should the cover be cut or damaged, improper bonding between layers tends to permit further degradation of the cover or even complete disintegration of the ball layers.

Various types of surface treatment techniques are known for use in modifying polymer surfaces. These techniques include mechanical abrasion; chemical abrasion, such as etching; and high-voltage electrostatic discharge, also known as corona treatment. See, e.g., U.S. Pat. No. 5,466,424 (corona discharge surface treating method) and Stobbe, Bruce, "Corona Treatment 101," Label and Narrow Web Indus., May-June, 1996.

One method of modifying polymer surfaces is plasma treating. Plasma treatment of various shapes and types of polymers in general is well known. See, e.g., Kaplan, S. L., "Cold Gas Plasma Treatment for Re-Engineering Films," Paper Film Foil Converter, 71(6) June, 1997; Rose, P., et al., "Treating Plastic Surfaces with Cold Gas Plasmas," Plastics Engineering, pp. 41-45 (October, 1985). Plasma treatment generally oxidizes the surface of a material being treated. For example, U.S. Pat. No. 5,387,842 discloses a steady-state, glow discharge plasma generated within the volume between a pair of parallel, insulated metal plate electrodes spaced up to 5 cm apart and RF energized with an rms potential of 1 to 5 KV at 1 to 100 KHz. The electrodes are disclosed to be located within an enclosure capable of maintaining an atmosphere other than atmospheric air, such as a noble gas, between the electrode surfaces. See also U.S. Pat. Nos. 5,316,739 and 5,098,483 (methods of treating spherical surfaces).

U.S. Pat. No. 5,414,324 discloses a similar parallel plate apparatus and process, but charges the electrodes with an impedance matching network adjusted to produce a stable, uniform glow discharge at atmospheric pressure, which is also known as corona discharge.

U.S. Pat. Nos. 5,403,453 and 5,456,972 disclose polymer materials, such as film and fabrics, that may be non-destructively surface treated to improve water wettability by exposure to a glow discharge plasma sustained at substantially atmospheric pressure in a modified gas atmosphere of helium or argon.

U.S. Pat. No. 4,919,434 discloses a golf ball having a cover which includes an inner cover layer and an outer cover layer, each of which includes a thermoplastic resin. Preferably, the layers are formed of materials capable of fusion bonding with each other to properly adhere the layers together.

JP Patent Document No. 60215374 discloses a golf ball made of synthetic resin, wherein the golf ball cover surface is subjected to microwave plasma treatment to improve the thin coating layer's peeling resistance against shock or flexing fatigue. This process is disclosed as greatly reducing treatment time from 10 to 24 hours down to several minutes.

U.S. Pat. No. 4,613,403 discloses a method for treating a golf ball surface made of balata resin, thermoplastic elastomer, ionomer resin, or the like with unpolymerizable gas plasma and subsequently applying the usual coating in an apparatus adapted to expose the surface of the ball to the plasma. The process is alleged to make the coating on the golf ball hard-exfoliative, i.e., more mar-resistant.

U.S. Pat. No. 5,286,532 discloses a method for producing golf balls by surface-treating the golf ball with atmospheric pressure plasma prior to finish coating to provide a good adhesion of the coating to the golf ball, which coating is highly resistant to discoloration and deterioration.

However, these references do not disclose methods for treating one or more internal layers within a multilayer ball, i.e., other than on the surface, to provide golf balls having improved durability and acceptable playing characteristics, such as low driver spin and high initial velocity. It is thus desirable to provide a method capable of producing such multilayer golf balls, which golf balls themselves are also novel.

SUMMARY OF THE INVENTION

The invention relates to a golf ball including a core having an outer surface that is sufficiently treated to increase adhesion thereof and a cover layer having a thickness of at least about 0.007 inches and a plurality of dimples, wherein the cover layer is disposed concentrically about the core and bonded to the core at the treated surface and the golf ball is substantially free of adhesive. In particular, the surface is treated by exciting a gas to a plasma state and applying the gas to the surface being treated under sufficient conditions to increase the adhesion capability of the surface to enhance or facilitate bonding with an adjacent layer. The surface may also be treated by chemical means, such as etching, to increase adhesion capability.

In one embodiment, the invention relates to a golf ball including a core having a corona-discharge treated outer surface to increase adhesion thereof to an adjacent layer and a cover layer having a thickness of at least about 0.007 inches and a plurality of dimples, wherein the cover layer is disposed concentrically about the core and bonded to the core at the treated outer surface.

In another embodiment, the present invention relates to a golf ball including a core having a plasma-treated surface and a cover layer having a thickness of at least about 0.007 inches and having a plurality of dimples, wherein the cover layer is disposed concentrically about the core and is bonded to the core. Plasma treatment includes at least one of low pressure plasma treatment or corona-discharge treatment, the latter of which is typically conducted at or around atmospheric pressure. It should be understood that any of these types of surface treatment may be used with any of the following embodiments.

Optionally, but preferably, the cover layer is disposed about the core without need for an adhesive between the core and cover layer. In one embodiment, the ball contains three or more layers; it should be understood that the cover layer having dimples is disposed over a core made of two or more layers. Thus, what is often called an "inner cover layer" in golf balls having a core and a cover layer including an inner cover layer and an outer cover layer should be understood herein to be the outermost layer of the core about which a cover layer having dimples is disposed.

As used herein, the terms "cover" and "cover layer" refer to the outermost layer of a golf ball that contains dimples. Any desired type of coating, such as paint, lacquer, or the like, may be disposed about the cover layer, i.e., about the golf ball, in any manner known to those of ordinary skill in the art. As used herein, the term "core" means the one or more layers of a golf ball about which the cover layer is disposed. As used herein, the outer, and in particular the outermost, core layers may be comprised of either thermoset rubber compositions, thermoplastic resins, or the like.

In one embodiment, the core has a single layer. In another embodiment, the core includes a center and an intermediate layer disposed about the center. Any number of optional intermediate layers may also be disposed between the center and cover layer. In a preferred embodiment, the core includes a center and at least one intermediate layer disposed about the center, with the outermost intermediate layer being treated, e.g., by low pressure plasma treatment or corona discharge treatment, to facilitate adhesion of the cover layer to the core. In a more preferred embodiment, there are two intermediate layers.

In another embodiment, the core includes a center, and at least one intermediate layer disposed about the center, wherein at least one intermediate layer is treated to facilitate bonding to the adjacent layer. Preferably, the intermediate layer adjacent the cover layer is treated to facilitate bonding between the outermost intermediate layer of the core and the cover. In another embodiment, at least one of the intermediate layers includes a material having a flex modulus of about 50,000 psi and the cover layer has a thickness of less than about 0.045 inches and includes at least one of a thermoset material or a thermoplastic material. In a preferred embodiment, the cover layer has a thickness of from about 0.014 inches to 0.04 inches.

In yet another embodiment, the cover layer has a Shore D hardness of less than about 75. In a preferred embodiment, the cover layer has a Shore D hardness of between about 40 to 65. In another embodiment, at least one of the intermediate layers and the cover layer has a flexural modulus of about 50,000 psi to 120,000 psi. In another embodiment, the treated surface includes a material having a surface energy from about 40 dyne/cm$^2$ to 70 dyne/cm$^2$. In another embodiment, the intermediate layer adjacent to the cover layer has a Shore D hardness of at least about 50. In a preferred embodiment, the intermediate layer has a Shore D hardness of about 65 to 74.

In one embodiment, the cover includes any suitable material known to those of ordinary skill in the art, such as a thermoset material as noted above that is selected from the group of polyisoprene, polybutadiene, polyurethane, polysulfide rubber, polyurea, polyester, epoxy resin, and mixtures thereof. In a preferred embodiment, the cover includes a thermoplastic material of a material selected from the group of a polyolefin, polyamide, polyester, polytrimethylene terephthalate, copoly(ether-ester), copoly(ester-ester), polyamide, copoly(urethane-ester), copoly(urethane-ether), polyacrylate, polystyrene, styrene-butadiene-styrene copolymer, styrene-ethylene-butylene-styrene copolymer, polypropylene, ethylene-propylene-diene terpolymer or ethylene-propylene vulcanized copolymer rubber, polycarbonate, and mixtures thereof.

In another embodiment, the intermediate layer most closely adjacent to the cover includes an ionomer resin, a polyurethane, a polyetherester, a polyetheramide, a polyester, a vulcanized elastomer, a functionalized styrenebutadiene elastomer, a metallocene polymer, a polyamide, or acrylonitrile butadiene-styrene copolymer, or a blend thereof.

In one embodiment, an outer diameter of the intermediate layer adjacent to the cover layer is less than about 1.666 inches. In another embodiment, the core includes a center and at least two intermediate layers disposed progressively concentrically about the center. In yet another embodiment, the center may be solid, hollow, or fluid-filled. In another embodiment, at least one intermediate layer includes a length of tensioned elastomeric material. In one embodiment, the golf ball is substantially free of adhesive between the cover and the treated surface.

The invention also encompasses a golf ball including a core having a center layer and at least two intermediate layers disposed concentrically about the center layer, and a cover disposed concentrically about the core, wherein at least one of the core layers is treated at an interface with an adjacent layer that is bonded thereabout.

The golf balls of the invention may be prepared, for example, by forming at least one layer of a golf ball, treating an outermost surface of the at least one layer at a pressure, and bonding at least a portion of a cover layer concentrically about the at least one layer so as to form a cover layer having a thickness of at least about 0.007 inches and a plurality of dimples. In a preferred embodiment, the treating is accomplished by applying a gas excited to a plasma state to the surface being treated. In a more preferred embodiment, the gas is excited to the plasma state by RF energy, electron beam, microwave, electrical discharge, or other suitable methods known to those of ordinary skill in the art. Indeed, a primary or secondary method may be used. Primary methods include those where the surface to be treated is placed in the plasma field, while secondary methods include those where the plasma is blown or otherwise moved onto the surface to be treated.

In a preferred embodiment, the pressure at which the plasma treatment is conducted is below atmospheric pressure. In another embodiment, the at least one layer includes a core. In a preferred embodiment, the core includes a center and at least one treated intermediate layer disposed about the center. In a more preferred embodiment, the at least one layer further includes a second intermediate layer disposed outwardly adjacent to a treated first intermediate layer. In another embodiment, the second intermediate layer is also treated and is disposed between the center and the treated first intermediate layer.

In one embodiment, the portion of the cover material bonded to the treated layer includes a thermoset material. In another embodiment, the portion of the cover material is formed by casting a reactive liquid material or by compression or injection molding, but preferably is formed by casting. In yet another embodiment, the method further includes mechanically abrading at least a portion of an outermost surface of at least one layer. In another embodiment, the at least one layer has a surface energy of less than about 50 dyne/cm$^2$ before treating. In a preferred embodiment, the layer that is treated and the adjacent layer bonded thereto include different materials.

BRIEF DESCRIPTION OF THE DRAWINGS

Further features and advantages of the invention can be ascertained from the following detailed description that is provided in connection with the drawings described below.

DETAILED DESCRIPTION OF THE INVENTION

Figure 1:
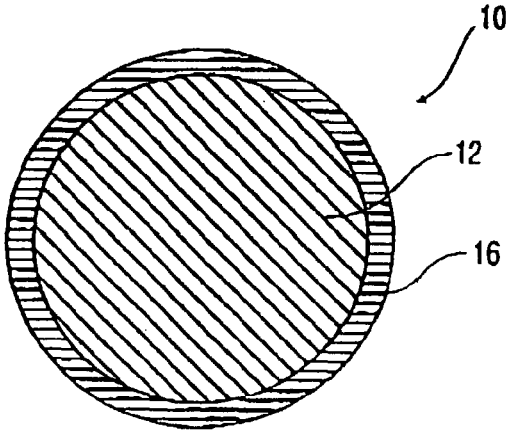
FIG. 1 is a cross-sectional view of a two-piece golf ball according to the invention having a cover and a core.

It has now been discovered that multilayer golf balls, i.e., those having two or more layers, having improved bonding between two or more layers, may be achieved by treating a surface of at least a portion of one or more such layers, typically at the surface of the layer. The treated surface is ultimately disposed within the golf ball with the cover having a plurality of dimples that is disposed about the surface. The treatment includes any chemical or mechanical process that improves or facilitates adhesion of the treated surface to an adjacent surface, typically by low pressure plasma treatment, corona discharge treatment, chemical etching, or the like. Preferably, the treatment includes at least one of low pressure plasma treatment or corona discharge treatment. This advantageously results, for example, in a cover and core having reduced delamination, even upon repeated impact, due to improved bonding therebetween that inhibits degradation of the cover and preferably inhibits or prevents delamination or tear of a bonded, i.e., treated, layer(s). Golf balls prepared according to the present invention are thus provided with improved durability and/or playing characteristics to inhibit degradation when struck by a club.

The improved methods and golf balls of the present invention are provided by treating at least a portion of the surface of at least one of a golf ball center, or an intermediate layer, e.g., the outermost intermediate layer that forms an interface between the core and the cover layer. The treatment should be sufficient to reduce or avoid the use of adhesives at the interface between the treated layer and the layer disposed thereabout. Without being bound by theory, it is believed that plasma treatment, e.g., low pressure plasma treatment(s) and corona discharge treatment(s) remove low molecular weight portions of the material to be treated by oxidation thereof and modify the surface chemistry to promote adhesion on an atomic level.

Any suitable form of treatment may be used to facilitate bonding one or more of these layer interfaces in a golf ball. The treatment is preferably provided to at least a portion of a layer having a low surface energy. When plasma treatment is included in the treatment, it is typically provided using a gas at a low temperature from about 0° C. to 100° C., preferably from about 20° C. to 90° C., more preferably from about 30° C. to 80° C. Such low temperatures advantageously inhibit undesired modification or thermal degradation of the golf ball surface being treated. This surface typically contains materials that may be degraded or modified at higher temperatures. Although the plasma treatment may be conducted at any pressure, in a preferred embodiment the plasma treatment is conducted below atmospheric pressure, i.e., low pressure plasma treatment. In this embodiment, the pressure is preferably at a pressure from about 0.01 to 10 Torr, more preferably about 0.05 Torr to 1 Torr, and most preferably about 0.08 Torr to 0.4 Torr.

Any gas suitable for plasma treatment may be used. Gases typically used in the plasma treatment include air, oxygen, nitrogen, argon, ammonia, or helium. Preferably, the gas is oxygen or air, and more preferably the gas is oxygen. The plasma treatment according to the invention should be conducted for a suitable amount of time sufficient to increase the adhesiveness of the surface being treated. Preferably, however, the treatment time is less than about 30 minutes, more preferably less than about 20 minutes, and most preferably less than about 10 minutes.

Any source of energy is suitable for facilitating the plasma treatment according to the invention. Preferably, however, the energy source includes direct electrical current, low frequency electrical current, high frequency electrical current, radio frequency, and microwave electrical. More preferably, radio frequency energy of greater than about 1 kHz, preferably greater than about 1 MHZ, and more preferably from about 1 MHz to 50 MHz is used to charge the gas for plasma treatment. An exemplary radio frequency is 13.56 MHZ in which the plasma treatment is provided to the surface of a portion of the golf ball being treated.

In one embodiment, at least a portion of the layer being treated is also treated by one or more additional methods, such as by mechanical abrasion. The additional abrasion may be concurrent or sequential with the treatment in any order, e.g., mechanical abrasion followed by a treatment, such as low pressure plasma or corona discharge. Particularly, at least a portion of a layer in the ball may be treated by both plasma and mechanical abrasion. Vibratory tumbling is one form of mechanical abrasion and is accomplished by agitating the surfaces being treated with a media that contains abrasive particles, which is well known to those of ordinary skill in the art. In this embodiment, the treatment and the mechanical abrasion are preferably concurrent. In a preferred embodiment of the invention, at least a portion of a layer in the golf ball is sand blasted and then treated with at least one of low pressure plasma treatment, corona discharge treatment, or chemical treatment.

When corona discharge treatment in used in place of the low pressure plasma treatment described herein for treating the surface within the golf ball, it is typically conducted at ambient pressure. It should be understood that "plasma treatment" can include either low pressure plasma treatment or corona discharge treatment. Corona discharge is well known by those of ordinary skill in the art and can be readily adapted for use according to the invention based on the disclosure herein. Corona discharge typically involves an electrical discharge that causes oxygen or other gas molecules within the discharge area to break into their atomic form, leaving them free to bond onto molecules on the surface of the treated article. It should be understood that use of treatment to abrade the surface of the core or the surface of a layer in the core is preferred, whether the treatment is done with low pressure plasma treatment alone, with corona discharge alone, or with one of these two treatments in conjunction with one or more different suitable abrasion methods of the surface of the layer to increase the adhesion of the treated layer and an adjacent layer.

When chemical abrasion, such as etching, is used in place of, or in addition to, the other treatment according to the invention as described herein for treating the surface within the golf ball, it is typically conducted at ambient pressure. Any conventional etching chemical(s) may be used to etch a surface of within a golf ball to improve adhesion between the treated surface and the adjacent layer.

The golf balls prepared according to the invention, which have improved adhesion of at least a portion of the interface between layers where at least one layer has been treated according to the invention, can now be provided with a construction having a thin layer of a relatively soft thermoset material formed from a castable reactive liquid. As used herein, the term "thermoset" material refers to a crosslinked polymer that is a reaction product of two or more precursor materials, e.g., polyurethane.

The balls prepared according to the invention may be made of any materials capable of being treated according to the invention, preferably olefinic polymers, ionomeric polymers, or both, as well as other low surface energy materials. Those of ordinary skill in the art will understand that the term "low surface energy materials" as applied to such materials typically refers to those materials having a surface energy of less than about 50 dyne/cm$^2$ prior to treatment, typically from about 25 to 40 dyne/cm$^2$, and such artisans are well aware of a variety of materials suitable for golf balls, many of which are capable of being treated according to the invention. For example, SURLYN materials typically have a surface energy of about 34 dyne/cm$^2$. In a preferred embodiment of the invention, the surface energy of a layer is increased by at least about 2 dyne/cm$^2$, preferably by at least about 5 dyne/cm$^2$, and more preferably by at least about 10 dyne/cm$^2$, after treatment according to the invention to facilitate bonding with an adjacent layer. Examples of suitable materials are discussed below in connection with a preferred embodiment of the invention, which materials can of course be used in any combination to provide other suitable golf balls according to the invention.

In one particular embodiment, the golf balls prepared according to the invention are multilayer golf balls including a core and a cover layer. The core may be solid, hollow, or fluid-filled. Specifically, it has been determined that the cover layer should have a thickness of about 0.045 inches or less, preferably from about 0.007 and 0.04 inches. Most preferably, this cover thickness is from about 0.014 to 0.03 inches.

The cover layer in this embodiment is preferably formed from a relatively soft thermoset material that replicates the soft feel and high spin play characteristics of a balata ball when the balls of the present invention are used for short iron shots. In particular, the cover layer in this embodiment should have a Shore D hardness of from about 40 to 80, preferably from about 45 to 70 and more preferably from about 50 to 65. Additionally, the materials of the thin cover layer are provided with a degree of resistance to shear and delamination according to the present invention, which makes them more suitable for use as a golf ball cover.

The cover layer of this embodiment can include any suitable thermoset material formed from a reactive liquid material. Suitable thermoset materials include polyisoprene, polybutadiene, polyurethane, styrene-butadiene-styrene rubber, polysulfide rubber, polyurea, polyester, epoxy resins, and any copolymers or mixtures thereof (e.g., urethane ionomer, urethane epoxy). The preferred materials for the cover layer include, but are not limited to, castable thermoset urethanes, including thermoset urethane ionomers and thermoset urethane epoxies. Examples of suitable urethane ionomers are disclosed in U.S. Pat. No. 5,692,974. Several other suitable urethanes are disclosed in U.S. Pat. Nos. 5,334,673; 5,484,870; 5,733,428; 5,888,437; and 5,908,358. The disclosure of each of these urethane patents is incorporated herein in its entirety by express reference thereto.

Thermoset polyurethanes and urethanes are particularly preferred for use in the cover layer for this embodiment of the invention. Polyurethane is a product of a reaction between a polyol or diamine, and a diisocyanate.

Conventionally, thermoset polyurethanes are prepared using a diisocyanate, such as 2,4-toluene diisocyanate (TDI) or methylenebis-(4-cyclohexyl isocyanate) (HMDI) and a polyol which is cured with a polyamine, such as methylenedianiline (MDA), or a trifunctional glycol, such as trimethylol propane, or tetrafunctional glycol, such as N,N,N',N'-tetrakis (2-hydroxypropyl)ethylenediamine. One preferred cover formulation is a reaction product of 4,4'-diphenylmethane-diisocyanate (MDI), polytetramethylene ether glycol (PTMEG Polyol), and polytetramethyleneoxide-di-p-aminobenzoate (commercially available, for example, as POLAMINE 250 or VERSALINK P-250). The present invention is not, however, limited to just these specific types of thermoset polyurethanes. Quite to the contrary, any suitable thermoset polyurethane may be employed to form the cover layer of this or any other embodiment of the invention.

The outermost layer of the core optionally, but preferably, has a Shore D hardness of at least about 50, preferably from about 65 to 74. Furthermore, as defined herein, the term "high flexural modulus" means a flexural modulus (as measured by ASTM-790) of at least about 50,000 psi, preferably from about 70,000 psi to 120,000 psi, and more preferably from about 75,000 psi to 110,000 psi. These layers are typically considered relatively hard and are particularly suitable for surface treatment according to the invention. The thickness of the outermost core layer can range from about 0.02 inches to 0.06 inches, preferably from about 0.035 inches to 0.045 inches, more preferably from about 0.04 inches to 0.4 inches.

Any suitable thermoplastic material(s) may be used in the any layer of the ball having a core with two or more layers. The following thermoplastic material(s) are preferably included in the cover layer having a plurality of dimples. Particularly suitable thermoplastic materials for the cover include ionomer materials of a polyolefin, polyamide, polyester, polytrimethylene terephthalate, copoly(ether-ester), copoly(ester-ester), polyamide, polyether, copoly(urethane-ester), copoly(urethane-ether), polyacrylate, polystyrene, styrene-butadiene-styrene copolymer, styrene-ethylene-butylene-styrene copolymer, polypropylene, ethylene-propylene-diene terpolymer or ethylene-propylene dynamically vulcanized copolymer rubber, polycarbonate, mixtures thereof, and the like. Preferably, ionomers usefull in the invention are copolymers of an olefin and an α, β-ethylenically unsaturated carboxylic acid in which at least a portion of the carboxylic acid groups have been neutralized with a metal ion, typically sodium, lithium, magnesium, or zinc. More preferably, the olefin is ethylene, and the α, β-ethylenically unsaturated carboxylic acid is acrylic or methacrylic acid, where the metal ion is zinc, sodium, magnesium, manganese, calcium, lithium or potassium. As used herein, the terms "ionomer," "ionomer resin," and "thermoplastic ionomer" are synonymous.

These layers may alternatively be formed from a wide variety of hard, high flexural modulus resilient materials. Among the preferred materials for this layer are hard, high flexural modulus ionomer resins and blends thereof. Particularly suitable ionomers for this purpose are obtained by providing a cross metallic bond to polymers of mono-olefin with at least one member selected from the group consisting of unsaturated mono- or di-carboxylic acids having 3 to 12 carbon atoms and esters thereof (the polymer contains about 1% to 50% by weight of the unsaturated mono- or di-carboxylic acid and/or ester thereof). More particularly, such acid-containing ethylene copolymer ionomer components include E/X/Y copolymers where E is ethylene, X is a softening comonomer such as acrylate or methacrylate present in an amount of up to about 50, preferably up to about 25, and more preferably up to about 20, weight percent of the polymer, and Y is acrylic or methacrylic acid present in an amount from about 5 to 35, preferably from about 16 to 35, and more preferably from about 16 to 20, weight percent of the polymer, wherein the acid moiety is neutralized at least about 1% to 90%, preferably at least about 40%, more preferably at least about 60%, to form an ionomer by a cation such as lithium, sodium, potassium, magnesium, calcium, barium, lead, tin, zinc or aluminum, or a combination of such cations. Lithium, sodium, magnesium, zinc, or a combination thereof, are preferred for neutralization of the acid moiety. Specific acid-containing ethylene copolymers include ethylene/acrylic acid, ethylene/methacrylic acid, ethylene/acrylic acid/n-butyl acrylate, ethylene/methacrylic acid/n-butyl acrylate, ethylene/methacrylic acid/iso-butyl acrylate, ethylene/acrylic acid/iso-butyl acrylate, ethylene/methacrylic acid/n-butyl methacrylate, ethylene/acrylic acid/methyl methacrylate, ethylene/acrylic acid/methyl acrylate, ethylene/methacrylic acid/methyl acrylate, ethylene/methacrylic acid/methyl methacrylate, and ethylene/acrylic acid/n-butyl methacrylate. Preferred acid-containing ethylene copolymers include ethylene/methacrylic acid, ethylene/acrylic acid, ethylene/methacrylic acid/n-butyl acrylate, ethylene/acrylic acid/n-butyl acrylate, ethylene/methacrylic acid/methyl acrylate and ethylene/acrylic acid/methyl acrylate copolymers. The most preferred acid-containing ethylene copolymers are ethylene/methacrylic acid, ethylene/acrylic acid, ethylene/(meth)acrylic acid/n-butyl acrylate, ethylene/(meth)acrylic acid/ethyl acrylate, and ethylene/(meth)acrylic acid/methyl acrylate copolymers.

The manner in which the ionomers used in the cover layer are made is well known in the art as described in, e.g., U.S. Pat. No. 3,262,272, which is incorporated herein in its entirety by express reference thereto. Such ionomer resins are commercially available from DuPont Co. of Wilmington, Del. under the tradename SURLYN® and from Exxon under the tradename IOTEK®. Some particularly suitable SURLYNS® include SURLYN®8140 (Na) and SURLYN®8546 (Li), which have an methacrylic acid content of about 19%.

However, the materials are not limited to ionomer resins. Any suitable material available to those of ordinary skill in the art can be employed in this layer, such as thermoplastic or thermoset polyurethanes, thermoplastic or thermoset polyetheresters or polyetheramides, thermoplastic or thermoset polyester, a vulcanized elastomer, styrene-butadiene elastomer, a metallocene, maleic anhydride grafted styrene-ethylene-butylene-styrene copolymers, a polyamide, acrylonitrile butadiene-styrene copolymer, or blends thereof.

Suitable thermoplastic polyetheresters include materials which are commercially available from DuPont under the tradename Hytrel®. Suitable thermoplastic polyetheramides include materials which are available from Elf-Atochem of Philadelphia, Pa. under the tradename Pebax®. Other suitable materials for the outermost core layer include a polyamide, such as nylon, and acrylonitrile-butadiene-styrene copolymer (ABS).

In general, the treatment of at least a portion of a layer in a golf ball to improve adhesion between the treated layer and an adjacent layer is preferred for use with either: (a) a layer that is harder than a softer layer being disposed thereabout; or (b) a material having a low surface energy. The surface treatment according to the invention is believed, without being limited by theory, to inhibit or prevent adhesion loss between the bonded layers in the ball due to high shear forces imparted to the ball when struck by a club. The surface treatment according to the invention is also believed, again without being limited by theory, to increase the surface energy of the surface to be treated and bonded.

The golf ball cores of the present invention may be prepared using a variety of constructions. For example, the core of the golf ball may include a conventional center surrounded by at least one intermediate layer disposed between the center and the cover layer. The core may be a single layer or may comprise a plurality of layers. The innermost portion of the core may be solid, hollow, or a fluid-filled sphere. In a preferred embodiment, the ball includes core having a center and two intermediate layers and a cover layer disposed about the core. In this embodiment, the outermost intermediate layer that forms the surface of the core is treated prior to the cover being disposed thereabout.

In another embodiment, the core includes a solid or liquid filled center about which a length of tensioned elastomeric material is wound. The solid center is typically a homogenous mass of a resilient material, such as polybutadiene. The liquid-filled center is typically a thin-walled sphere made from a thermoplastic or thermoset elastomeric material into which a fluid is introduced. The windings included in an intermediate layer disposed about either type of center are provided by an elastic thread that is stretched and wound about the center to a desired thickness.

The materials for solid layers in the core typically includes compositions having a base rubber, and optionally, one or more of a crosslinking agent, a filler, and a free-radical initiator. The base rubber typically includes natural or synthetic rubbers. A preferred base rubber is polybutadiene having a cis-isomer content of at least about 40%. If desired, the polybutadiene can also be mixed with one or more additional elastomers known in the art, such as polyisoprene rubber and/or styrene-butadiene rubber, to modify the properties of the core.

The crosslinking agent, which is preferably included, is typically a metal salt of an unsaturated fatty acid such as a zinc salt or a magnesium salt of an unsaturated fatty acid having 3 to 8 carbon atoms such as acrylic or methacrylic acid. Particularly suitable crosslinking agents include unsaturated metal salt acrylates, such as dimethacrylates and monomethacrylates, wherein the metal is typically magnesium, calcium, or zinc.

The free-radical initiator, which is preferably included, can be any known polymerization initiator that decomposes during the cure cycle of the polybutadiene or additional elastomer(s). Particularly suitable initiators include peroxide compounds such as dicumyl peroxide, 1,1-di(t-butylperoxy) 3,3,5-trimethyl cyclohexane, a-a bis (t-butylperoxy) diisopropylbenzene, 2,5-dimethyl-2,5 di(t-butylperoxy) hexane, or di-t-butyl peroxide, and the like, and mixtures thereof. Suitable crosslinking agents and free-radical initiators are well known to those of ordinary skill in the art.

As used herein, the term "filler" includes any compound or composition that can be used to vary the density or other properties of a layer of the ball, typically of one or more layers of the core. Fillers typically include materials, such as zinc oxide, barium sulfate, silica, calcium carbonate, regrind, and the like.

The overall outer diameter (OD) of the core of the golf balls of the present invention is from about 1.5 inches to 1.666 inches, preferably from about 1.6 inches to 1.652 inches, and more preferably from about 1.62 to 1.64 inches when a golf ball having a diameter of 1.68 inches is desired. However, the present multilayer golf ball can have an overall diameter of any size. Although the United States Golf Association (USGA) specifications limit the minimum size of a competition golf ball to at least 1.68 inches in diameter, there is no 5 specification as to the maximum diameter. Moreover, golf balls of any size can be used for recreational play. The preferred diameter of the present golf balls is from about 1.68 inches to 1.8 inches. The more preferred diameter is from about 1.68 inches to 1.76 inches. The most preferred diameter is from about 1.68 inches to 1.74 inches.

The cores of the present golf balls can be prepared by any process employed in the golf ball art. For example, the solid centers or any additional intermediate layers can be injection or compression molded or wound about the center or other intermediate layers.

In a preferred embodiment of the golf ball, however, it is not practical to form the cover layer of the ball using conventional injection or compression molding techniques ordinarily employed in the golf ball art for applying cover materials due to the very thin nature (about 0.045 inches or less) of the cover layer. These conventional ball molding processes are not capable of easily applying such thin cover layers over a solid spherical surface. Accordingly, this embodiment preferably uses a castable, reactive material that is applied in a fluid form to obtain very thin cover layers on golf balls. Specifically, it has been found that castable, reactive liquids that react to form a thermoset material provide desirable very thin cover layers.

When castable, reactive liquids, in particular polyurethanes, are employed to form the thermoset material, as discussed herein, they can be applied over the core by the casting technique disclosed in U.S. Pat. No. 5,733,428, titled "Method And Apparatus For Forming Polyurethane Cover On A Golf Ball", the disclosure of which is hereby incorporated herein in its entirety by express reference thereto. Similarly, U.S. Pat. No. 5,006,297 to Brown et al. and U.S. Pat. No. 5,334,673 to Wu also disclose suitable casting techniques that may be utilized to apply castable reactive liquids when employed in the present invention. The disclosures of these patents are hereby incorporated herein in their entirety by express reference thereto. However, the method of the invention is not limited to the use of these techniques, particularly where non-reactive liquids are used to form the cover layer having dimples.

FIG. 1 illustrates a two-piece golf ball 10 of the invention having a core 12 treated according to the invention, and a cover 16 disposed about the treated core.

Figure 2:
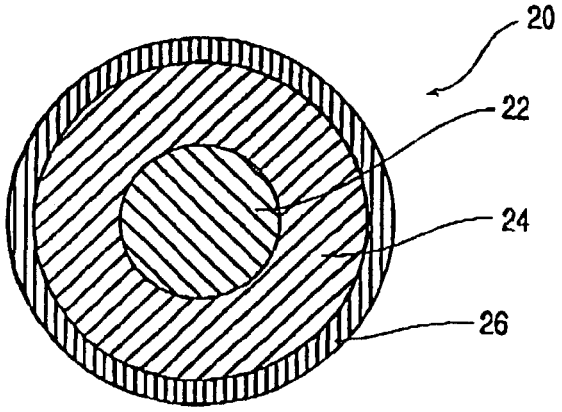
FIG. 2 is a cross-section of a golf ball according to the invention having an intermediate layer between a cover and a core.

FIG. 2 illustrates a three-piece golf ball 20 of the invention. The center 22 is surrounded by one intermediate layer 24. A cover 26 is disposed about the intermediate layer 24. If desired, the center 22 and the intermediate layer 24 may both be made from the same materials disclosed and taught herein, in which case, however, they are not made from exactly the same materials in the same ratios. In FIG. 2, at least a portion of at least one of the center 22 or the intermediate layer 24, or both, are treated according to the invention. In one embodiment, either in addition to or alternative to other embodiments, the center 22 is hollow or fluid-filled instead of solid.

Figure 3:
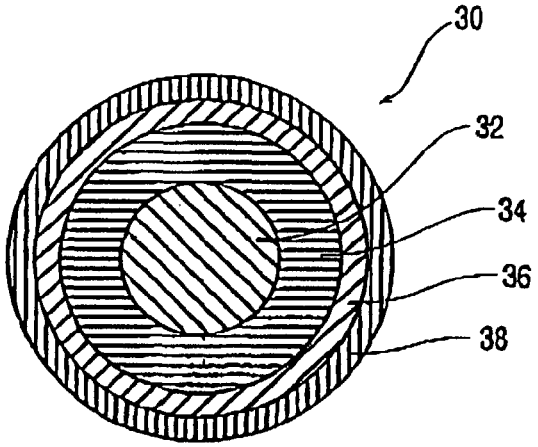
FIG. 3 is a cross-section of a golf ball depicted in FIG. 2 according to the invention having more than one cover layer.

FIG. 3 illustrates a four-layer golf ball 30 produced in accordance with this invention. The center 32 may be solid, hollow, or fluid-filled, and is surrounded by a first intermediate layer 34. A second intermediate layer 36 is disposed about the first intermediate layer 34. A portion of the surface of at least one of the center 32, first intermediate layer 34, or second intermediate layer 36 may be treated according to the invention using any suitable materials. It should be understood that the term "surface" in relation to a given layer is the 20 surface at the interface between the treated layer and the adjacent layer that is disposed outwardly thereabout, e.g., surface of the first intermediate layer 34 is between the first intermediate layer 34 and the second intermediate layer 36. If the center is fluid-filled, however, it is preferred that the first intermediate layer 34 includes a layer surrounding the fluid-filled center, e.g., a flexible enclosure, that is made of materials known to those skilled in the art, and that the surface of the first intermediate layer 34 or the second intermediate layer 36, or both, be treated according to the invention. A thin cover layer 38 is disposed about the core over the second intermediate layer 36.

A preferred embodiment of the invention includes low pressure plasma treatment or corona discharge treatment of a sufficient portion of the outer surface of at least one layer within the golf ball to improve adhesion between the treated layer and an adjacent layer. Exemplary materials, layer thicknesses, and the like are discussed in U.S. Pat. No. 5,885,172, which is hereby incorporated herein by express reference thereto.

The term "about," as used herein in connection with one or more numbers or numerical ranges, should be understood to refer to all such numbers, including all numbers in a range.

EXAMPLES

The following examples of multilayer golf balls formed according to the present invention is given to illustrate the present invention. However, it is to be understood that the example is for illustrative purposes only and in no manner is the present invention limited to the specific disclosures therein.

Example 1

Golf Ball Prepared According to The Invention

Golf balls of the present invention can be manufactured as follows. The core may be made, for example, using either a conventional wound core construction or a conventional two-piece core construction formed using methods well known in the art. The wound core construction can be either a solid elastomeric center or a liquid filled center around which a length of elastic thread is wound. A conventional two-piece construction preferably comprises a predominantly cis-polybutadiene rubber that has been crosslinked with a metal salt of an unsaturated fatty acid, such as zinc diacrylate. This construction is then covered using a conventional compression molding technique with an intermediate layer, which becomes the outermost core layer, of an ionomer having a methacrylic acid content of at least about 16 weight percent (preferably SURLYN 8140 or SURLYN 8546).

The cover layer can then be formed following the processes set forth, for example, in U.S. Pat. Nos. 5,006,297 and 5,334,673. A particularly desired material for forming the cover layer is a 60D castable urethane, which is the reaction product of 4,4'-diphenylmethane-diisocyanate, polytetramethylene ether glycol, and polytetramethyleneoxide-di-p-aminobenzoate.

It is believed that golf balls made in accordance with the present invention will exhibit an appreciably lower spin rate when struck with a driver (and thus a greater overall distance) as compared to conventional "high performance" golf balls (e.g., Tour Balata [Titleist]), but have very similar or even higher spin rates when struck with an 8 iron and/or a "5 yard" wedge.

Examples 2-5

Comparative Test of Balls Having Abraded Cores

A statistically significant sample size of 240 golf balls was prepared using a 1.55 inch diameter solid center and an intermediate layer about a center, with the layer being sufficiently thick to provide an outer diameter of 1.62 inches to the core. This outermost core layer had a hardness of about 68 Shore D. These portions of golf balls were prepared in three ways: (a) no surface treatment; (b) low pressure plasma treatment for four minutes in oxygen having a flow rate of 250 cm.sup.3/min. under a vacuum pressure of 0.2 Torr with radio frequency energy at 13.56 MHZ and at 225 W; and (c) corona discharge exposure for two seconds at an intensity of 12 kV at a frequency of 30 kHz. A thin urethane cover layer having a thickness of approximately 0.03 inches was applied to each group of 120 abraded ball portions by casting to form golf balls.

TABLE 1

PLASMA-TREATED CORE COMPARED TO CONVENTIONAL CORE

| | Untreated Core | Low Pressure Plasma-treated | Corona Discharge treated |
|---|---|---|---|
| Peak Load (lb.) | 1.5 | 15.5 | 15 |
| Static Load (lb.) | 1 | 12.8 | 12.5 |

Table 1 provides the value for the peak load and static load, as well as indicating that the treatment does not adversely affect initial velocity of the balls when identically struck by a club. A golf ball is fixed at two opposite poles and a strip having a width of 0.25 inches is cut around the circumference and then cut across its width to create a tab. The tensile peeling method used these tabs to obtain the data above. The peak load indicates the maximum force needed to begin pulling the cover layer tab further off the surface of the core. The static load indicated the average force required to separate the cover strip from the core due to the extreme adhesion provided between the core and cover layers.

Plasma treatment has been shown to provide superior adherence of the urethane cover layer to the plasma-treated core surface according to the invention.

While it is apparent that the illustrative embodiments of the invention herein discloses fulfills the objective stated above, it will be appreciated that numerous modifications and other embodiments and test methods may be devised by those skilled in the art. Therefore, it will be understood that the appended claims are intended to cover all such modifications and embodiments which come within the spirit and scope of the present invention.

We claim:

1. A golf ball comprising:

a core;

an inner cover layer comprising an ionomer resin having treated outer surface, wherein the treated outer surface is a product of a surface treatment consisting essentially of mechanical abrasion and corona discharge, and wherein the treated outer surface is substantially free of adhesive; and an outer cover layer comprising a castable reactive liquid thermoset material cast around the inner cover layer, wherein the thickness of the outer cover layer is about 0.007 inches or greater, and wherein the outer cover has a hardness of about 40 Shore D to about 65 Shore D.

2. The golf ball of claim 1, wherein the outer cover layer has a thickness of about 0.007 inches to about 0.045 inches.

3. The golf ball of claim 2, wherein the outer cover layer has a thickness of about 0.014 inches to about 0.03 inches.

4. The golf ball of claim 1, wherein the outer cover layer has a flexural modulus of about 50,000 psi to about 120,000 psi.

5. The golf ball of claim 1, wherein the outer cover layer comprises polyurethane, polyurea, or a mixture thereof.

6. The golf ball of claim 1, wherein the reactive liquid thermoset material comprises the reaction product of an isocyanate and a diamine.

7. The golf ball of claim 1, wherein the treated outer surface is a product of sand blasting and corona discharge.

8. A golf ball comprising:

a core;

an inner cover layer comprising a thermoplastic material having a treated outer surface, wherein the treated outer surface is the product of a surface treatment consisting essentially of mechanical abrasion and corona discharge, and wherein the treated outer surface is substantially free of adhesive; and an outer cover layer comprising a castable reactive liquid thermoset material bonded to the inner cover layer, wherein the outer cover layer has a thickness of about 0.007 inches to about 0.045 inches.

9. The golf ball of claim 8, wherein the thermoplastic material comprises an ionomer resin.

10. The golf ball of claim 8, wherein the castable reactive liquid thermoset material comprises urethane.

11. The golf ball of claim 8, wherein the corona discharge raises the surface energy of the inner cover layer.

12. The golf ball of claim 8, wherein the inner cover layer has a flex modulus between about 50,000 psi to about 120,000 psi.

13. The golf ball of claim 8, further comprising an interface between the inner cover layer and the outer cover layer, wherein the interface is substantially free of adhesive.

14. The golf ball of claim 8, wherein the reactive liquid thermoset material comprises polyurea.

15. The golf ball of claim 8, wherein the reactive liquid thermoset material comprises the reaction product of an isocyanate and a diamine.

16. A method for forming a golf ball consisting essentially of the steps of:

forming a core;

forming an inner cover layer comprising a thermoplastic material having an outer surface;

mechanically abrading the inner cover layer;

subjecting the inner cover layer to corona discharge to increase its adhesion, wherein the outer surface is substantially free of adhesive; and casting an outer cover layer comprising a reactive liquid thermoset material having a thickness of about 0.007 inches to about 0.045 inches about the inner cover layer.

17. The method of claim 16, wherein the inner cover layer comprises ionomer resin.

18. The method of claim 16, wherein the outer cover layer comprises urethane.

19. The method of claim 16, wherein the step of casting an outer cover layer comprising a reactive liquid thermoset material comprises the step of reacting an isocyanate and a diamine.

20. The method of claim 16, wherein the step of mechanically abrading the inner cover layer comprises subjecting the inner cover layer to sand blasting.

21. The method of claim 16, wherein the reactive liquid thermoset material is selected from the group consisting of polyisoprene, polybutadiene, polyurethane, styrene-butadiene-styrene rubber, polysulfide rubber, polyurea, polyester, epoxy resin, urethane ionomers, urethane epoxy, and mixtures thereof.

22. The method of claim 16, wherein the step of casting an outer cover layer comprises casting a thermoset polyurethane about the inner cover layer.

* * * * *